US008584375B2

(12) United States Patent
Horiba et al.

(10) Patent No.: US 8,584,375 B2
(45) Date of Patent: Nov. 19, 2013

(54) METHOD OF DRYING HONEYCOMB ARTICLE, AND DRYING APPARATUS THEREFOR

(75) Inventors: Yasuhiro Horiba, Nagoya (JP); Hiromi Shimada, Nagoya (JP); Yohei Takemori, Nagoya (JP); Shinzou Hayashi, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 805 days.

(21) Appl. No.: 12/552,805

(22) Filed: Sep. 2, 2009

(65) Prior Publication Data

US 2009/0320315 A1 Dec. 31, 2009

Related U.S. Application Data

(63) Continuation of application No. PCT/JP2008/053625, filed on Feb. 29, 2008.

(30) Foreign Application Priority Data

Mar. 28, 2007 (JP) ..... 2007-084030

(51) Int. Cl.
*F26B 3/00* (2006.01)
*F26B 7/00* (2006.01)
*B28B 5/00* (2006.01)

(52) U.S. Cl.
USPC ..... 34/475; 34/474; 34/443; 34/437; 264/630

(58) Field of Classification Search
USPC ..... 34/443, 265, 437, 487, 373, 467, 474, 34/475; 264/630, 177.12, 428
See application file for complete search history.

(56) References Cited

U.S. PATENT DOCUMENTS 4,448,833 A * 5/1984 Yamaguchi et al. ..... 428/116
5,263,263 A 11/1993 Gheorghiu et al.
5,513,447 A 5/1996 Yoshida (Continued)

FOREIGN PATENT DOCUMENTS

DE 2113848 A * 9/1972
DE 2113848 A1 9/1972

(Continued)

OTHER PUBLICATIONS

Michel Riepen, Drying with Super Heated Steam, An Innovative Approach, TNO Institute of Applied Physics, http://www.wood-drying-centre-europe.com/downloads/puiblic/SteamDryingBasics.pdf.*

(Continued)

*Primary Examiner* — Kenneth Rinehart
*Assistant Examiner* — John McCormack
(74) *Attorney, Agent, or Firm* — Oliff & Berridge, PLC

(57) ABSTRACT

The drying method performs drying the honeycomb formed article by such an arrangement that superheated steam or mixed gas of steam and hot air, temperature and humidity of which is regulated so that wet-bulb temperature thereof becomes 70° C. or higher, is made to pass through the cells of the honeycomb formed article. The drying apparatus includes a steam supply unit that supplies the superheated steam, a buffer chamber that aligns the superheated steam supplied from the steam supply unit, an upper chamber disposed above the buffer chamber to locate the honeycomb formed article, and a hood unit that recovers the superheated steam which has passed through the honeycomb formed article.

11 Claims, 4 Drawing Sheets

(56) References Cited

U.S. PATENT DOCUMENTS

| | | | | |
|---|---|---|---|---|
| 7,197,839 | B2 * | 4/2007 | Terazawa et al. | 34/259 |
| 7,721,461 | B2 * | 5/2010 | Ishii et al. | 34/265 |
| 2002/0093123 | A1 | 7/2002 | Miura et al. | |
| 2002/0109269 | A1 | 8/2002 | Miura et al. | |
| 2005/0136239 | A1 * | 6/2005 | Eichinger et al. | 428/304.4 |
| 2007/0006480 | A1 | 1/2007 | Ishii et al. | |

FOREIGN PATENT DOCUMENTS

| | | | |
|---|---|---|---|
| EP | 2 083 000 | A1 | 7/2009 |
| JP | A-2-233551 | | 9/1990 |
| JP | A 7-246613 | | 9/1995 |
| JP | A-7-315910 | | 12/1995 |
| JP | A 2002-283329 | | 10/2002 |
| JP | A 2002-283330 | | 10/2002 |
| JP | A-2003-53719 | | 2/2003 |
| JP | 2006308137 | A * | 11/2006 |
| JP | A 2006-308137 | | 11/2006 |
| WO | WO 2005/023503 | A1 | 3/2005 |
| WO | WO 2008/053647 | A1 | 5/2008 |

OTHER PUBLICATIONS

European Search Report dated Dec. 9, 2011 issued in European Patent Application No. 08712147.1.

Aug. 7, 2012 Office Action issued in European Patent Application No. 08 712 147.1.

May 30, 2012 Chinese Office Action issued in Patent Application No. 2008800100163 (with translation).

* cited by examiner

METHOD OF DRYING HONEYCOMB ARTICLE, AND DRYING APPARATUS THEREFOR

This is a Continuation of Application No. PCT/JP2008/053625 filed Feb. 29, 2008, which claims the benefit of Japanese Patent Application No. 2007-084030 filed Mar. 28, 2007. The disclosure of the prior applications is hereby incorporated by reference herein in its entirety.

TECHNICAL FIELD

The present invention relates to a drying method and a drying apparatus therefor of a honeycomb formed article which is an unfired article of a honeycomb structure.

BACKGROUND ART

A honeycomb structure is widely used for catalyst carrier, various types of filter and the like. Recently, the honeycomb structure attracts attention as a diesel particulate filter (DPF) for trapping particulate matter emitted from diesel engines.

Generally, a principal component of the honeycomb structure is ceramics in many cases. To fabricate such a honeycomb structure, firstly water and various additives such as binder are added to raw material of ceramics to prepare kneaded clay, then a formed article with a shape of honeycomb (honeycomb formed article) is made through extrusion forming. After drying the honeycomb formed article, this honeycomb formed article is fired and then fabrication of the honeycomb structure can be achieved.

As drying methods of the honeycomb formed article, an dielectric drying method, which uses high frequency energy generated by current between electrodes provided upper and lower part of the honeycomb formed article, and a hot air drying method, which performs drying through introducing hot air generated by gas burner and the like, are well known. However in these days, in place of or in addition to these drying methods, a drying method utilizing microwaves (microwaves drying method), which has advantages of quick drying speed and the like (for example, refer to Patent Documents 1 to 3) has been adopted.

However, such microwave drying method has had difficulty in drying the whole honeycomb formed article in a uniform speed, due to delayed drying in the upper and lower end portion or in the peripheral portion of the honeycomb formed article compared with other portion in drying process. The honeycomb formed article shrinks when water evaporates whereby when drying speed is not uniform, defects such as deformation and breakage tend to happen easily. Moreover, thinning of partition wall (rib) to separate cells has been progressed and the thinner the partition wall of the honeycomb formed article is, the more easily deformation of the honeycomb formed article occurs. Consequently, uniformalizing of drying speed has especially become to be an important object recently.

Patent Document 1: JP-R 2002-283329

Patent Document 2: JP-A 2002-283330

Patent Document 3: WO 2005/023503 Pamphlet

DISCLOSURE OF THE INVENTION

The present invention has been developed in view of the foregoing problems in the prior art and the object is to provide a method of drying a honeycomb formed article and drying apparatus therefor, with which a honeycomb formed article can be dried within a shortened period of time while inhibiting any occurrence of defects such as deformation and breakage.

According to the present invention, it is provided a drying method of an unfired honeycomb formed article including raw material composition containing ceramics raw material, water, and binder, and having a plurality of cells, the cells being separated by partition walls to be passage of fluid, wherein superheated steam or mixed gas of steam and hot air, having the humidity thereof regulated so as to realize a wet-bulb temperature of 70° C. or higher, is arranged to pass through the cells to dry the honeycomb formed article.

In the present invention, it is preferred that the binder has heat gelation characteristic or thermosetting characteristic.

Moreover, according to the present invention, a honeycomb formed article is provided, which comprises: a steam supply unit that supplies superheated steam; a buffer chamber that rectifies the superheated steam supplied from the steam supply unit; an upper chamber that is disposed above the buffer chamber to locate the honeycomb formed article, where the superheated steam passes through inside of the honeycomb formed article; and a hood unit that recovers the superheated steam which has passed through the honeycomb formed article.

In the present invention, it is possible to dry a honeycomb formed article in a shorter period of time, while inhibiting any occurrence of defects such as deformation and breakage.

DESCRIPTION OF REFERENCE NUMERALS

1: honeycomb formed article, 2: partition wall, 3: cell, 7: external peripheral wall, 10: drying apparatus, 12: steam supply unit, 14: buffer chamber, 16: upper chamber, 18: honeycomb formed article, 20: hood unit, 22: work piece placing plate

DESCRIPTION OF THE PREFERRED EMBODIMENT

Hereinafter, preferable embodiments of the present invention will be described. However, the present invention is not limited to the following embodiments and it should be understood that the following embodiments that are suitably modified or improved without departing from the gist of the present invention based on ordinary knowledge of a person skilled in the art are included in the scope of the present invention.

In drying method of a honeycomb formed article according to the present invention, superheated steam is arranged to pass through the cells of the honeycomb formed article, the temperature and the humidity of the superheated steam being regulated so that wet-bulb temperature is 70° C. or higher, and thereby the honeycomb formed article is dried. Hereinafter, the details thereof will be described.

Figure 1:
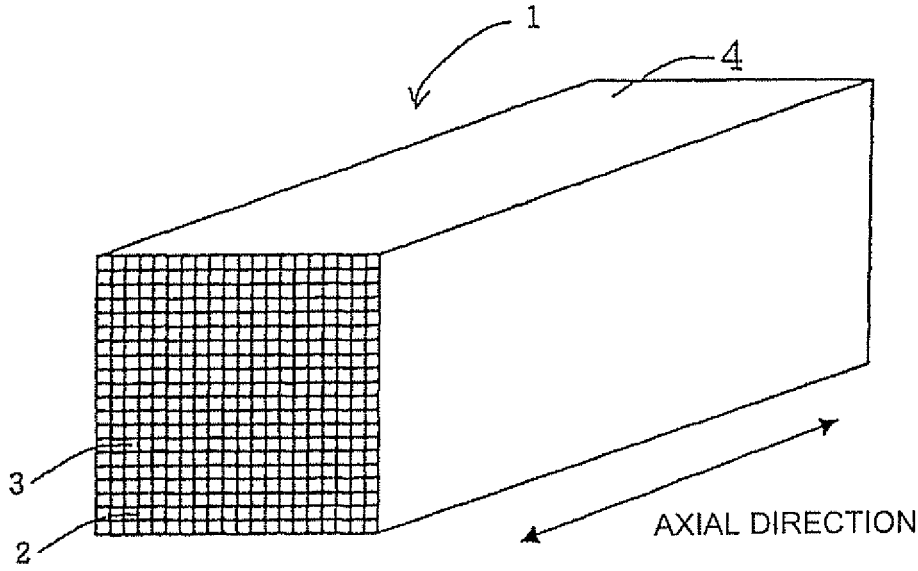
FIG. 1 is a perspective view showing an example of a honeycomb formed article which is used in a drying method of the honeycomb formed article according to the present invention.
Figure 2:
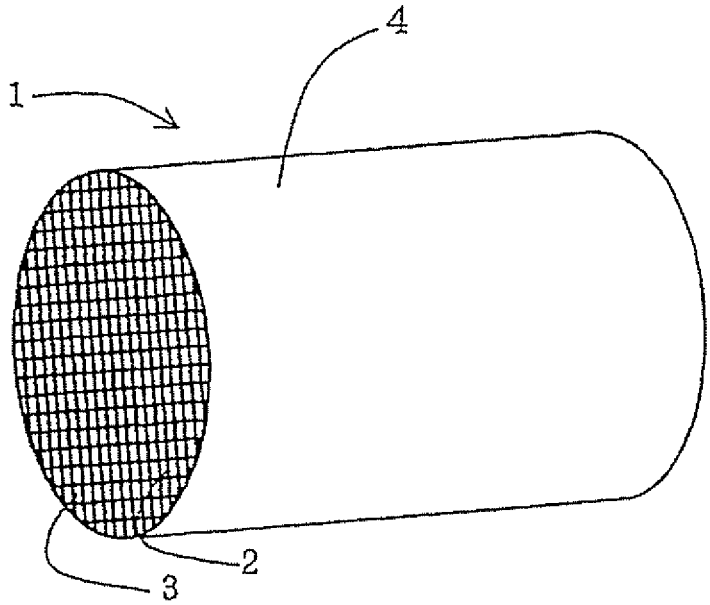
FIG. 2 is a perspective view showing another example of a honeycomb formed article which is used in a drying method of the honeycomb formed article according to the present invention.

In the drying method according to the present invention, the honeycomb formed article to be dried is, for example, the one which has such structure as shown in FIG. 1 and FIG. 2. That is, the honeycomb formed article 1 is provided with a plurality of cells which are fluid passages separated by the partition walls 2. Moreover, the honeycomb formed article 1 includes generally peripheral wall 4 which is provided to enclose a plurality of cells 3. The sectional shape perpendicular to the axial direction of the cell 3 (passage direction) is not limited and any shape can be selected including a quadrilateral as shown in FIG. 1, a circle as shown in FIG. 2 and the like.

The honeycomb formed article is an unfired article including raw material composition which contains ceramics raw material, water, and binder. As ceramics raw material, for example, oxide-type ceramics such as alumina, mullite, zirconia, cordierite and the like; and non-oxide type ceramics such as silicon carbide, silicon nitride, aluminum nitride, and the like can be mentioned. In addition, silicon carbide/metallic silicon composite material and silicon carbide/graphite composite material and the like can be used as well.

As binder having heat gelation characteristic and thermosetting characteristic, which is included in the ceramics formed article that is the object of the present invention, for example, methylcellulose, hydroxypropylmethylcellulose, carboxymethyl-cellulose, hydroxyethylcellulose, hydroxyethylmethylcellulose, and the like can be mentioned. Among which, methylcellulose is used most prevalently. Gelation temperature of these gelation binder depends on types but it is approximately 50 to 80° C. and about 55° C. for methylcellulose. Different types of gelation binder can be used in mixture.

When drying the honeycomb formed article which has the above mentioned constitution, superheated steam or mixed gas of steam and heated air having temperature and humidity thereof regulated so that the wet-bulb temperature is 70° C. or higher is used in the present invention. The wet-bulb temperature of superheated steam or mixed gas of steam and heated air is preferably 70 to 100° C. and more preferably 80 to 100° C. When the wet-bulb temperature of superheated steam or mixed gas of steam and heated air is lower than 70° C., heat gelation of the binder is insufficient and hence deformation of the honeycomb formed article is large while drying, causing cut or breakage at the end face. Optimal wet-bulb temperature of the mixed gas of the steam and the heated air is not determined to be a single value but should be modified corresponding to type of ceramics and type of binder.

The temperature of the superheated steam or the mixed gas of the steam and the heated air which is arranged to pass through the cells is preferably 60 to 300° C. and more preferably 70 to 200° C. When the temperature of the superheated steam which is arranged to pass through the cells is lower than 60° C., despite that the honeycomb formed article is heated, steam becomes dew-condensed state and consequently the honeycomb formed article absorbs humidity to be swollen, resulting into easy defects occurrence such as shape deformation. To the contrary, when the temperature is higher than 300° C., binder material is removed and the honeycomb formed article tends to become brittle resulting in easy deformation and breakage. Optimal temperature of the superheated steam is not a single value but should be modified corresponding to type of ceramics and type of binder.

Duration time of passing of the superheated steam through the cell, that is the required time for water of the honeycomb formed article to reach equilibrium, is varied depending on the shape, water, size, temperature and humidity of the steam or the like of the honeycomb formed article, but usually it is 10 to 120 minutes, preferably about 10 to 60 minutes. When the time for the superheated steam to pass through the cell is too short, state of equilibrium is not achieved sufficiently some times. Optimal temperature and time for the superheated steam to pass through the cell is not determined to be a single value but should be modified corresponding to type, shape, water, size, and the like of ceramics or temperature and humidity of the steam that is arranged to pass through.

Figure 3:
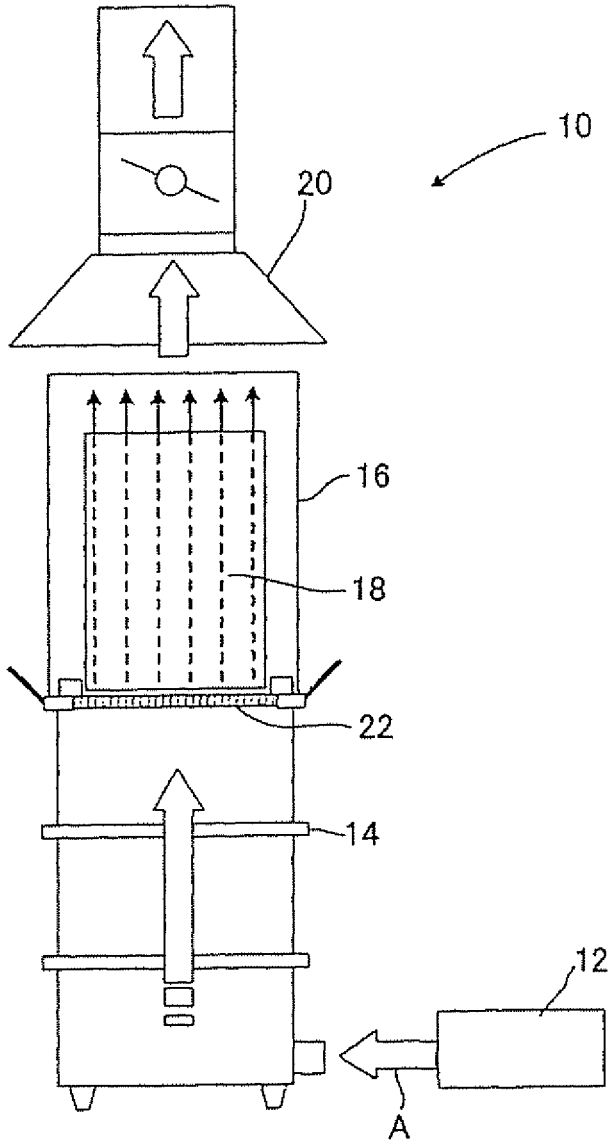
FIG. 3 is a schematic depiction showing an example of a drying apparatus of a honeycomb formed article according to the present invention.

FIG. 3 is a schematic depiction showing an example of drying apparatus of the honeycomb formed article according to the present invention. The drying apparatus 10 is provided with a steam supply unit 12 to supply superheated steam A, a buffer chamber 14 to align the superheated steam A supplied from the steam supply unit 12, an upper chamber 16 which is disposed above the buffer chamber 14 for locating the honeycomb formed article 18, and a hood unit 20 that recovers the superheated steam A which passes through the honeycomb formed article 18.

In this drying apparatus 10, the superheated steam A is supplied to the buffer chamber 14 from the steam supply unit 12. Here, the superheated steam A is introduced to the buffer chamber 14 from the side in the horizontal direction so that the superheated steam A is collided against an internal side wall of the buffer chamber 14, and thereafter the superheated steam A is arranged to ascend inside of the buffer chamber 14. In this way, the superheated steam A is aligned through collision against the internal side wall of the buffer chamber 14 and the superheated steam A ascends inside of the whole buffer chamber 14 with substantially constant speed.

Figure 4:
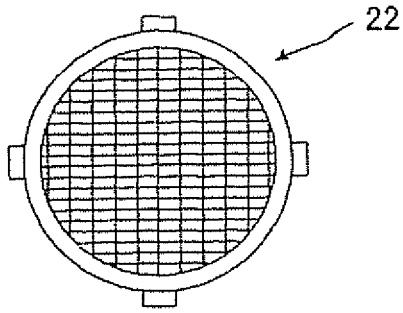
FIG. 4 is a plan view showing an example of a work piece placing plate.

The superheated steam A which is aligned in the buffer chamber 14 ascend inside of the buffer chamber 14, and then enters the upper chamber 16 provided above the buffer chamber 14. In the upper chamber 16, the honeycomb formed article 18 which is placed on the work piece placing plate 22 is disposed, and the superheated steam A passes through all of the cells of the honeycomb formed article 18 substantially uniformly to dry the whole of the honeycomb formed article 18 substantially uniformly. Note that it is preferable that the work piece placing plate 22, as shown in FIG. 4, is arranged to have equivalent cell density as the honeycomb formed article 18 has, so that the superheated steam A passes through the all cells of the honeycomb formed article 18 uniformly.

Next, the superheated steam A which has passed inside of the cells of the honeycomb formed article 18 enters the hood unit 20 disposed above the upper chamber 16 to be recovered.

Cell density, thickness of the partition wall, shape of cell and the size and the like of the honeycomb formed article which is an object in the drying method according to the present invention, is not limited specifically. It is especially effective to use in drying a honeycomb formed article with thin partition wall (for example, thickness of partition wall: 150 μm or less) which tends to cause deformation easily, or a large sized honeycomb formed article (for example, total length of passage: 200 to 1,000 mm, external diameter: 150 to 600 mm) which tends to cause difference of drying speed in each portion easily.

EXAMPLES

Hereinafter, the present invention will be described specifically based on examples. However, the present invention is not limited to these examples.

Examples 1, 2, and Comparative Example 1

A honeycomb formed article having outer shape shown in FIG. 2 which is fabricated using ceramics raw material of cordierite-type oxide, ceramics raw material of silicon carbide-type non-oxide, and forming auxiliary agent of methylcellulose (MC) as binder is prepared [(cordierite-type oxide ceramics formed article: outside diameter×passage length: 106 mmϕ×220 mm, number of cells: 93 cells/$cm^2$, thickness of partition wall: 64 μm), (silicon carbide-type non-oxide ceramics formed article: outside diameter×passage length: 35 mm (section is regular square)×330 mm, number of cells: 31 cells/$cm^2$, thickness of partition wall: 381 μm)]. Drying process was performed for the prepared honeycomb formed article as follows: a drying apparatus 10 which is provided with such an arrangement as shown in FIG. 3 was used; volume of steam was set at 50 kg/hr for the cordierite-type material, while 20 kg/hr for the silicon carbide-type material; superheated steam of 100 to 120° C. and hot air were mixed to obtain mixed gas, wet-bulb temperature of which was controlled to be 60° C., 70° C. and 80° C.; tact time of each material was adjusted 20 minutes or less to perform drying. By the way, the size of the buffer chamber 14 and upper buffer chamber 16 are as follows respectively: outside diameter× passage length: 440 mm×700 mm, 420 mm×800 mm. The work piece placing plate 22 that has equivalent cell density with the honeycomb formed article was used.

(Drying Condition)

Example 1

Hot air temperature 115° C.
Humidity 27%
Wet-bulb temperature 70° C.

Example 2

Hot air temperature 125° C.
Humidity 40%
Wet-bulb temperature 80° C.

Comparative Example 1

Hot air temperature 100° C.
Humidity 20%
Wet-bulb temperature 60° C.

Figure 5:
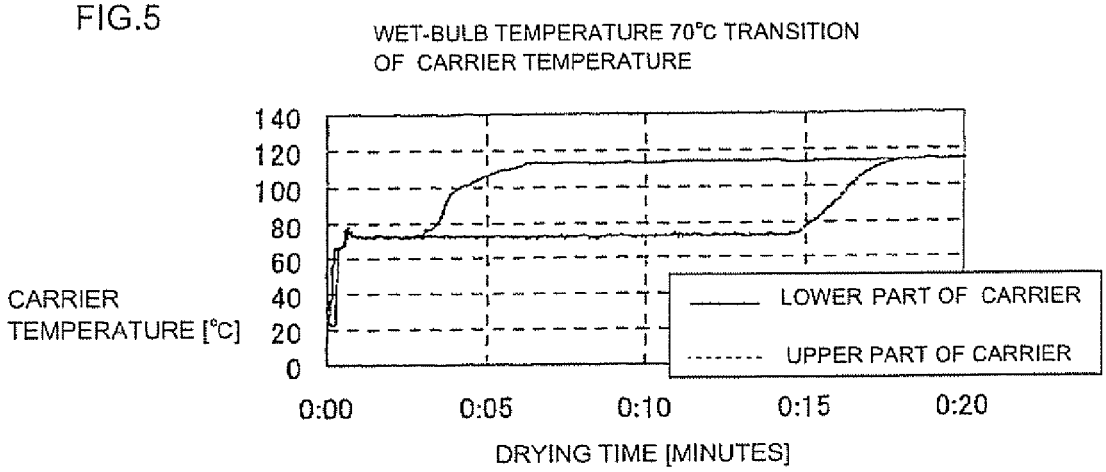
FIG. 5 is a graph showing temperature variation versus drying time of an example 1 of a honeycomb formed article.
Figure 6:
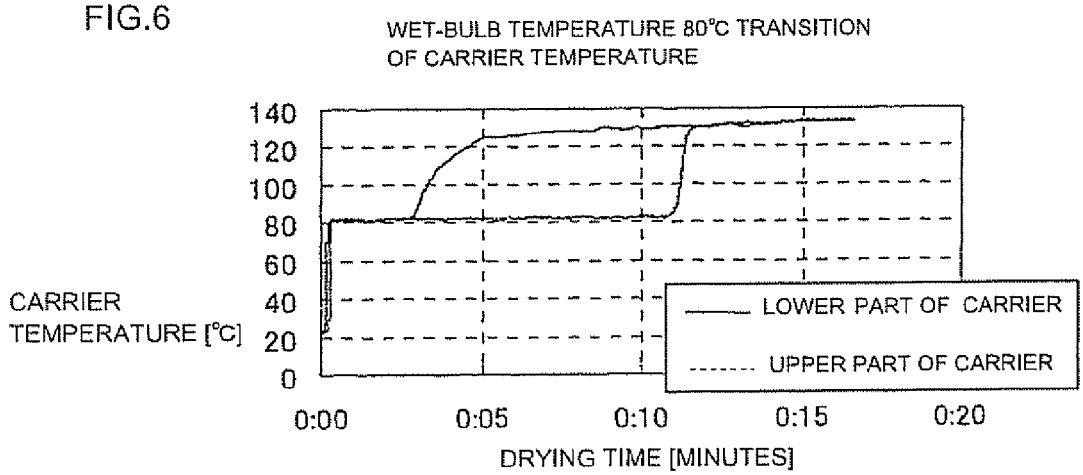
FIG. 6 is a graph showing temperature variation versus drying time of an example 2 of a honeycomb formed article.
Figure 7:
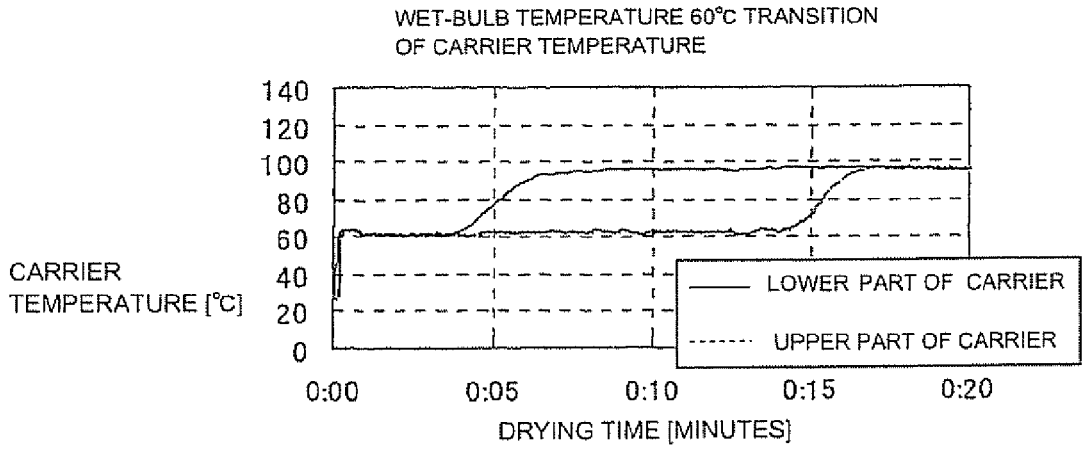
FIG. 7 is a graph showing temperature variation versus drying time of a comparative example 1 of a honeycomb formed article.

Temperature variation versus drying time of the honeycomb formed article (carrier) is shown in FIG. 5 (Example 1), FIG. 6 (Example 2), and FIG. 7 (Comparative example 1). As shown in FIGS. 5 to 7, it is evident that the temperature of the carrier during drying coincides with the wet-bulb temperature of the superheated steam or the mixed gas of steam and hot air, and after the water of the carrier reaches the state of equilibrium, the temperature of the carrier reaches the temperature of the superheated steam or the mixed gas of steam and hot air. In example 1, deformation of the honeycomb formed article was small and hence no cut occurs; in example 2, neither deformation nor cut of the honeycomb formed article occurred. On the other hand, in comparative example 1, deformation of the honeycomb formed article was large and hence cut on the end face occurred.

Example 3 and Comparative Example 2

Figure 8:
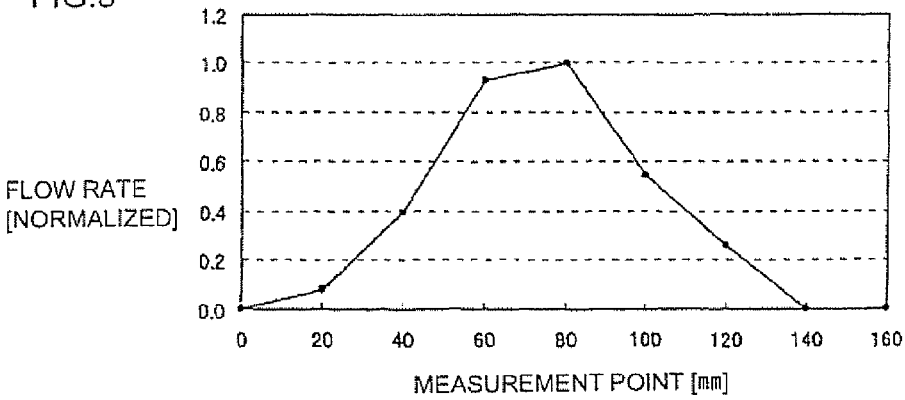
FIG. 8 is a graph showing a flow rate distribution of superheated steam without buffer chamber.
Figure 9:
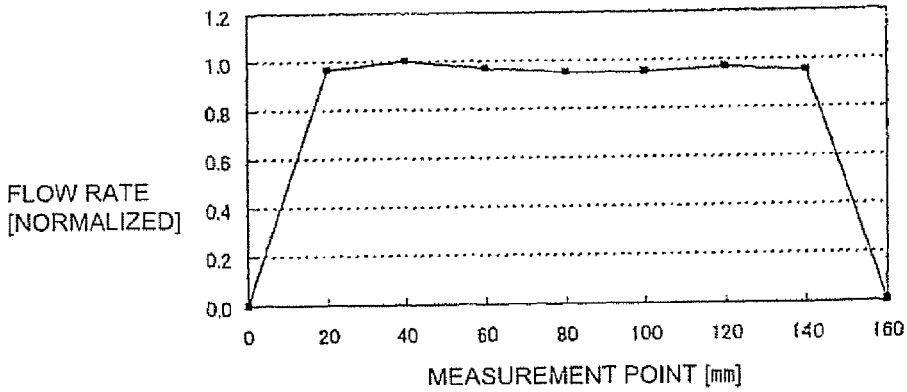
FIG. 9 is a graph showing a flow rate distribution of superheated steam with a buffer chamber.
Figure 10:
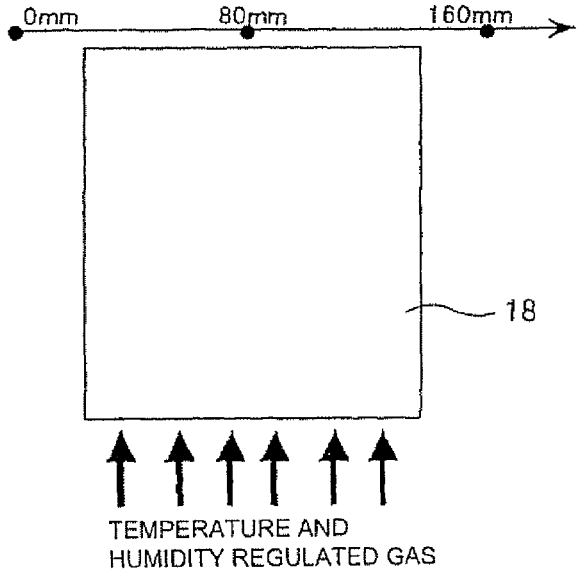
FIG. 10 is an explanation diagram showing measuring points of flow rate of superheated steam in the honeycomb formed article.

Experiment to confirm the effect of buffer chamber was conducted. That is, in the drying apparatus 10 used in examples 1 and 2, flow rate distribution of the superheated steam inside of the cell of the honeycomb formed article with/without the buffer chamber 14 was measured and compared for the both cases. The results are shown in FIGS. 8 and 9. By the way, FIG. 10 shows flow rate measurement points of the superheated steam.

As evident from FIGS. 8 and 9, the flow rate of the superheated steam inside of the cell of the honeycomb formed article varied much without the buffer chamber, and the flow rate of the superheated steam inside of the cell of the honeycomb formed article was uniform with the buffer chamber. In addition, uniformity of the flow rate of the superheated steam inside of the cell of the honeycomb formed article reduced drying distribution in radial direction of the honeycomb formed article.

INDUSTRIAL APPLICABILITY

Drying method and drying apparatus of the honeycomb formed article according to the present invention can preferably dry unfired article of honeycomb structure which is used widely for catalyst carrier and various filters such as DPF.

The invention claimed is:

1. A drying method of an unfired honeycomb formed article including a raw material composition containing ceramics raw material, water, and binder having a heat gelation characteristic or a thermosetting characteristic, and having a plurality of cells, the plurality of cells being separated by partition walls so as to allow a passage of fluid through the plurality of cells, wherein mixed gas of steam and hot air having the humidity thereof regulated so as to realize a wet-bulb temperature of 70° C. or higher and a temperature of 60° C. to 300° C., or superheated steam having a temperature of 60° C. to 300° C., ascends upwardly into the honeycomb formed article, and substantially uniformly passes through the plurality of cells so as to substantially uniformly dry an entirety of the honeycomb formed article.

2. An apparatus for drying a honeycomb formed article, comprising:

a steam supply unit that supplies superheated steam;

a buffer chamber that aligns the superheated steam supplied from the steam supply unit;

an upper chamber that is disposed above the buffer chamber to locate the honeycomb formed article, wherein the superheated steam passes through an inside of the honeycomb formed article; and a hood unit that recovers the superheated steam which has passed through the honeycomb formed article, wherein the superheated steam is introduced to the buffer chamber from a side thereof in a direction perpendicular to a direction in which the buffer chamber longitudinally extends, such that the superheated steam collides against an internal side wall of the buffer chamber and thereafter ascends through an inside of the buffer chamber in the direction in which the buffer chamber longitudinally extends.

3. The drying method of the honeycomb formed article according to claim 1, wherein the mixed gas or superheated steam passes through the plurality of cells for a duration of 10 to 60 minutes.

4. The drying method of the honeycomb formed article according to claim 1, wherein the partition walls have a thickness of 150 μm or less.

5. The drying method of the honeycomb formed article according to claim 1, wherein the honeycomb formed article defines a passage therethrough, and a length of the passage is 200 mm to 1,000 mm.

6. The drying method of the honeycomb formed article according to claim 1, wherein an external diameter of the honeycomb formed article is 150 mm to 600 mm in length.

7. The apparatus for drying the honeycomb formed article according to claim 2, further comprising a work piece placing plate disposed in the upper chamber, having a cell density substantially equivalent to a cell density of the honeycomb formed article, on which the honeycomb formed article is placed.

8. The apparatus for drying the honeycomb formed article according to claim 2, wherein the superheated steam passes through the inside of the honeycomb formed article for a duration of 10 to 60 minutes.

9. The apparatus for drying the honeycomb formed article according to claim 2, wherein the honeycomb formed article includes a plurality of cells, the plurality of cells being separated by partition walls, and the partition walls have a thickness of 150 μm or less.

10. The apparatus for drying the honeycomb formed article according to claim 2, wherein the honeycomb formed article defines a passage therethrough, and a length of the passage is 200 mm to 1,000 mm.

11. The apparatus for drying the honeycomb formed article according to claim 2, wherein an external diameter of the honeycomb formed article is 150 mm to 600 mm in length.

* * * * *